US008907653B2

(12) United States Patent
Lee

(10) Patent No.: US 8,907,653 B2
(45) Date of Patent: Dec. 9, 2014

(54) CIRCUIT OF OUTPUTTING TEMPERATURE COMPENSATION POWER VOLTAGE FROM VARIABLE POWER AND METHOD THEREOF

(71) Applicant: Samsung Electro-Mechanics Co., Ltd., Gyeonggi-do (KR)

(72) Inventor: Soo Woong Lee, Suwon-si (KR)

(73) Assignee: Samsung Electro-Mechanics Co., Ltd., Gyeonggi-Do (KR)

( * ) Notice: Subject to any disclaimer, the term of this patent is extended or adjusted under 35 U.S.C. 154(b) by 126 days.

(21) Appl. No.: 13/830,990

(22) Filed: Mar. 14, 2013

(65) Prior Publication Data

US 2013/0300393 A1 Nov. 14, 2013

(30) Foreign Application Priority Data

May 14, 2012 (KR) ..... 10-2012-0050832

(51) Int. Cl.
*G05F 3/16* (2006.01)
*G05F 3/02* (2006.01)

(52) U.S. Cl.
CPC ..... *G05F 3/02* (2013.01)
USPC ..... 323/313; 327/513; 327/539

(58) Field of Classification Search
USPC ..... 323/273, 275, 276, 304, 311, 312, 313, 323/314, 315, 316, 317; 327/83, 138, 262, 327/371, 378, 513, 530, 535, 537, 538, 539, 327/540, 541, 542, 543, 545, 546
See application file for complete search history.

(56) References Cited

U.S. PATENT DOCUMENTS

| | | | | |
|---|---|---|---|---|
| 5,281,906 | A * | 1/1994 | Thelen, Jr. | 323/313 |
| 6,531,914 | B2 * | 3/2003 | Kawakubo | 327/541 |
| 2008/0116875 | A1 * | 5/2008 | Ma | 323/313 |

FOREIGN PATENT DOCUMENTS

| | | | |
|---|---|---|---|
| JP | 2005-011133 | A | 1/2005 |
| JP | 2007-241777 | A | 9/2007 |
| JP | 2011-085470 | A | 4/2011 |
| KR | 1020000057646 | A | 9/2000 |
| KR | 10-2002-0041876 | A | 6/2002 |
| KR | 100799836 | B1 | 1/2008 |

* cited by examiner

*Primary Examiner* — Nguyen Tran
(74) *Attorney, Agent, or Firm* — Bracewell & Giuliani LLP; Brad Y. Chin

(57) ABSTRACT

Disclosed herein are a circuit of outputting a temperature compensation power voltage from variable power and a method thereof, the circuit including: a regulator circuit unit converting the variable power into a predetermined voltage desired by a system; a resistance compensation circuit unit provided at an output terminal of the regulator circuit unit, and compensating for a change in resistance value due to the temperature change; and a temperature sensor sensing a change in surrounding temperature of an electronic circuit system employing the regulator circuit unit and supplying an output value corresponding to the sensed temperature change to the resistance compensation circuit unit, to thereby allow the resistance compensation circuit unit to compensate for the change in resistance value due to the temperature change.

14 Claims, 5 Drawing Sheets

CIRCUIT OF OUTPUTTING TEMPERATURE COMPENSATION POWER VOLTAGE FROM VARIABLE POWER AND METHOD THEREOF

CROSS REFERENCE TO RELATED APPLICATIONS

This application claims the benefit under 35 U.S.C. Section 119 of Korean Patent Application Serial No. 10-2012-0050832, entitled "Circuit of Output ting Temperature Compensation Power Voltage from Variable Power and Method Thereof" filed on May 14, 2012, which is hereby incorporated by reference in its entirety into this application.

BACKGROUND OF THE INVENTION

1. Technical Field

The present invention relates to a circuit of outputting a temperature compensation power voltage from variable power and a method thereof, and more particularly to a circuit of outputting a temperature compensation power voltage from variable power and a method thereof, capable of compensating for a deterioration in output characteristics of a regulator due to a temperature change by using a regulator designed in only one-stage in a circuit having a large-width variable power voltage.

2. Description of the Related Art

In designing an electronic circuit system, one of the important decisive factors is to determine the level of a power voltage. The levels of power voltages optimized in respective systems may be different even in the case of the same application. Therefore, in many cases, integrated circuits used in the system need to be designed considering tine variable power voltage. In the oases where the power voltage is changed, voltages and currents at respective nodes of the circuit become changed. This change may cause many problems in linearity of the circuit, noises, and power consumption management. Therefore, in the cases where the variable voltage is used, a regulator is often used for conversion to a desired specific voltage to be used. Particularly, in the cases where an accurate power voltage is needed, the regulator may be designed in two stages by adding a low drop out (LDO) regulator thereto. The reason is that the 1-stage regulator does not lead to satisfactory output characteristics in the case of a variable power voltage varied in a large width. However, it is advantageous to design the regulator in two stages in view of performance, but this may cause the increase in size, power consumption, and system complexity. Therefore, the designer needs to regulate the number of stages of the regulator, synthetically considering performance, complexity, size, and the like by previously checking performances necessary for the system when he designs an electronic circuit system.

RELATED ART DOCUMENTS

Patent Documents (Patent Document 1) Korean Patent No. 10-0799836

(Patent Document 2) Korean Patent Laid-Open Publication No. 2000-0057646

SUMMARY OF THE INVENTION

An object of the present invention is to provide a circuit of outputting a temperature compensation power voltage from variable power and a method therefor, capable of compensating for a deterioration in output characteristics of the regulator due to the temperature change by using a regulator designed in only one stage in a circuit having a large-width variable power voltage.

According to an exemplary embodiment of the present invention, there is provided a circuit of outputting a temperature compensation power voltage from variable power, the circuit including: a regulator circuit unit composed of a serial-parallel of resistors, and converting the variable power into a predetermined voltage desired by a system; a resistance compensation circuit unit provided at an output terminal of the regulator circuit unit, and compensating for a change in resistance value due to the temperature change; and a temperature sensor sensing a change in surrounding temperature of an electronic an output value corresponding to the sensed temperature change to the resistance compensation circuit unit, to thereby allow the resistance compensation circuit unit to compensate for the change in resistance value due to the temperature change.

The resistance compensation circuit unit may be composed of a plurality of unit circuits connected in parallel with each other, the plurality of unit circuits consisting of resistors having different resistance values and transistors, which are connected in series with each other.

The unit circuit may be 4 in number, and when a predetermined ratio of resistance change value based on a base resistance value ($R_{base}$) is, all of the four resistance values for the unit circuits may be "$R_{base}$+2", "$R_{base}$+", "$R_{base}$−", and "$R_{base}$−2", respectively.

The transistors in the unit circuits may be electrically connected with the temperature sensor, and may compensate for the change in resistance value due to the temperature change by receiving the output value from the temperature sensor to thereby be switched on/off, so that a current is conducted or blocked through corresponding resistors connected in series with the transistors.

The transistor in each of the unit circuits may be a field effect transistor (FET).

The transistor in each of the unit circuits may be a metal oxide semiconductor field effect transistor (MOSFET).

The temperature sensor may be composed of bipolar junction transistors to show a different output according to the sensed temperature.

The temperature sensor may output different signal values (digital values) respectively corresponding to predetermined temperature ranges.

The temperature sensor may be set to output a digital value "11" in the temperature range of −40 0; a digital value "10" in the temperature range of 0 40; a digital value "01" in the temperature range of 40~80; and a digital value "00" in the temperature range of 80 120.

According to another exemplary embodiment of the present invention, there is provided a method of outputting a temperature compensation power voltage from variable power by using a circuit of outputting a temperature compensation power voltage from variable power including a regulator circuit unit, a resistance compensation circuit unit, and a temperature sensor, the method including: a) sensing, by the temperature sensor, a change in surrounding temperature of an electronic circuit system employing the regulator circuit unit; b) output ting, by the temperature sensor, a predetermined signal corresponding too the sensed temperature change, to thereby supply the signal to the resistance compensation circuit unit; c) receiving, by the resistance compensation circuit unit; b) outputting, by the temperature sensor, to thereby operate corresponding unit circuits composed of resistors and transistors in the resistance compensation circuit unit; and d) generating a voltage drop to allow a current to flow through the resistors in the unit circuits, to thereby compensate for the change in output voltage due to the temperature change, and then outputting a power voltage.

Here, in Stage b), the temperature sensor may output different signal values (digital values) corresponding to predetermined temperature ranges.

The temperature sensor may be set to output a digital value "11" in the temperature range of −40 0; a digital value "10" in the temperature range of 0 40; a digital value "01" in the temperature range of 40~80; and a digital value "00" in the temperature range of 80 120.

Here, in Stage b), the resistance compensation circuit unit may be composed of a plurality of unit circuits connected in parallel with each other, the plurality of unit circuits consisting of resistors having different resistance values and transistors, which are connected in series with each other.

The unit circuit may be 4 in number, and when a predetermined ratio of resistance change value based on a base resistance value ($R_{base}$) is, all of four resistance values for the unit circuits may be "$R_{base}$+2", "$R_{base}$+", "$R_{base}$−", and "$R_{base}$−2", respectively.

DESCRIPTION OF THE PREFERRED EMBODIMENTS

Terms and words used in the present specification and claims are not to be construed as a general or dictionary meaning but are to be construed as meanings and concepts meeting the technical ideas of the present invention based on a principle that the inventors can appropriately define the concepts of terms in order to describe their own inventions in the best mode.

Through the specification, unless explicitly described to the contrary, the word "comprise" and variations such as "comprises" or "comprising", will be understood to imply the inclusion of stated elements but not the exclusion of any other elements. In addition, the terms "-er", "-or", "module", and "unit" described in the specification mean units for processing at least one function and operation, and can be implemented by hardware components or software components and combinations thereof.

Exemplary embodiments of the present invention will now be described in detail with reference to the accompanying drawings.

Herein, before exemplary embodiments of the present invention are described, one example of a general temperature compensation output circuit of variable power will, be first described for better understanding of the present invention.

Figure 1:
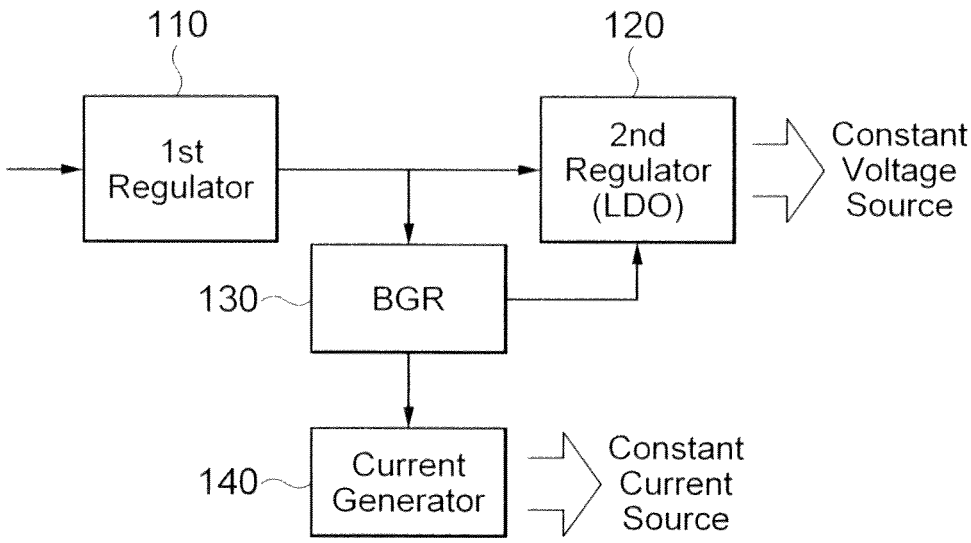
FIG. 1 is a diagram schematically showing a general structure of Dower voltage and current source generating circuit.
Figure 2:
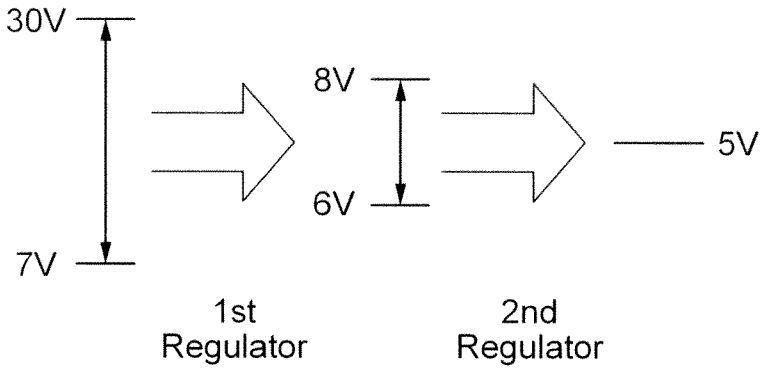
FIG. 2 is a view explaining an output voltage of a regulator in the circuit shown in FIG. 1.

FIG. 1 is a diagram schematically showing a general structure of power voltage and current source generating circuit, and FIG. 2 is a view explaining an output voltage of a regulator in the circuit shown in FIG. 1.

Referring to FIGS. 1 and 2, in a system where a power voltage is varied, a system (circuit) having a structure shown in FIG. 1 is used for stabilization of power voltage and current source. As shown in FIG. 2, it is assumed that a variable input power voltage is 7V~30V. In FIG. 2, a finally desired voltage level is 5V. First, a first regulator 110 receives a variable power voltage and first outputs a voltage of approximately a level of 6V 8V. In most cases, it is assumed that the output voltage was fluctuated by about 10% or higher under the influence of the temperature change and the like. Then, a stable output voltage of 5V may be finally obtained through a second regulator (LDO) 120, that is, LDO. The LDO 120 has a very small change width against the temperature. Since the output voltage of a band gap reference (BGR) 130 exhibiting stable characteristics against the temperature is multiplied, a stable output voltage of 5V proportional to the output voltage of BGR 130 may be obtained as long as the output voltage of the BGR 130 is stable despite the temperature change. However, in a circuit where circuit complexity, current consumption, and a size need to be decreased notwithstanding a little deteriorated performance, it is necessary to simply constitute the circuit. Reference numeral 140 in FIG. 1 indicates a current generator as a constant current source.

Figure 3:
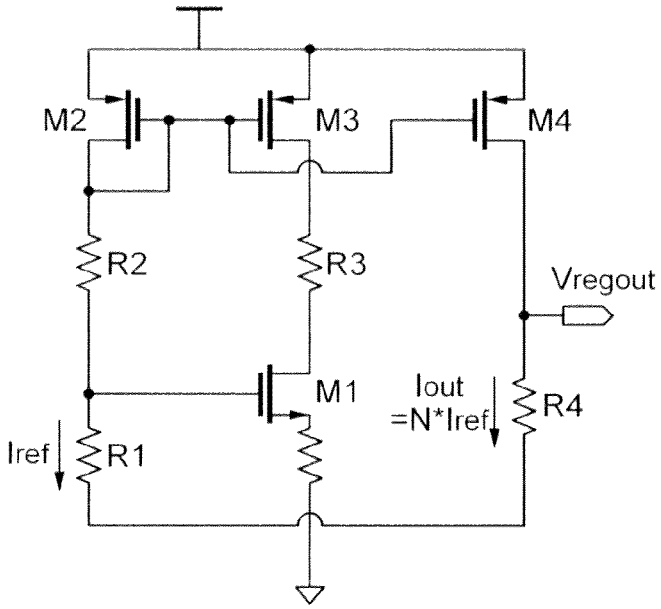
FIG. 3 is a view showing a circuit configuration of a general structure of a first regulator using a supply independent current source.

FIG. 3 is a view showing a circuit configuration of a general structure of a first regulator using a supply independent current source.

It can be seen that, referring to FIG. 3, a reference current (Iref) by the independent current source is determined by Equation 1 below, and thus, has a value independent from the power voltage.

$$Iref = \frac{Vgs(M1)}{R1} \quad \text{[Equation 1]}$$

The final output voltage (Vregout) of the first regulator is determined by the product of Iout(N*Iref), which is N multiplication value of the reference current, and R4, as shown in Equation 2 below.

Figure 4:
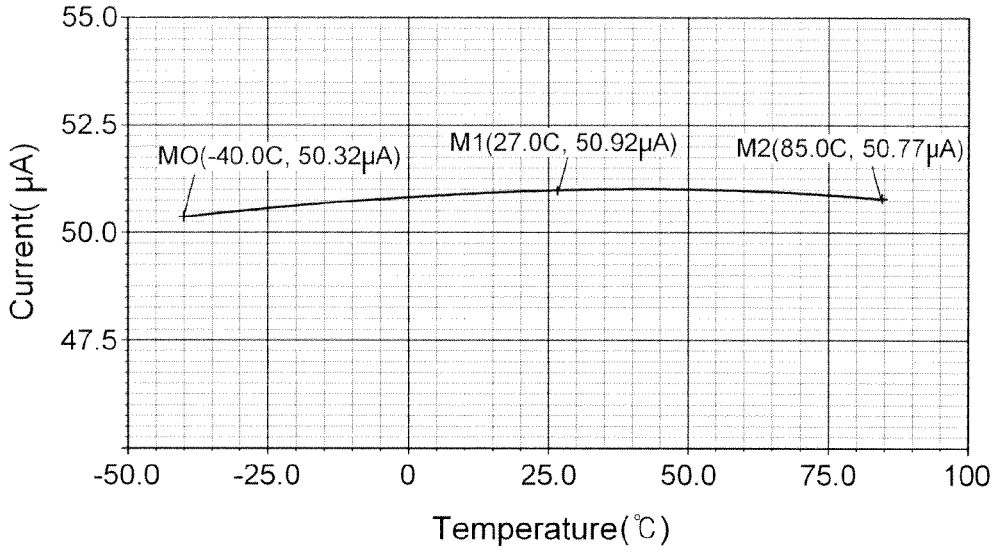
FIG. 4 is a view showing a simulation result of a reference current (Iref) by the current source of FIG. 3 depending on the temperature characteristics.

FIG. 4 is a view showing a simulation result of a reference current (Iref) by the current source of Equation 1 above depending on the temperature characteristics.

As shown in FIG. 4, it can be seen that only about 1% of current change is shown despite the temperature change of −40 85. It can be seen from the results that the current source is little influenced by the temperature change.

Figure 5:
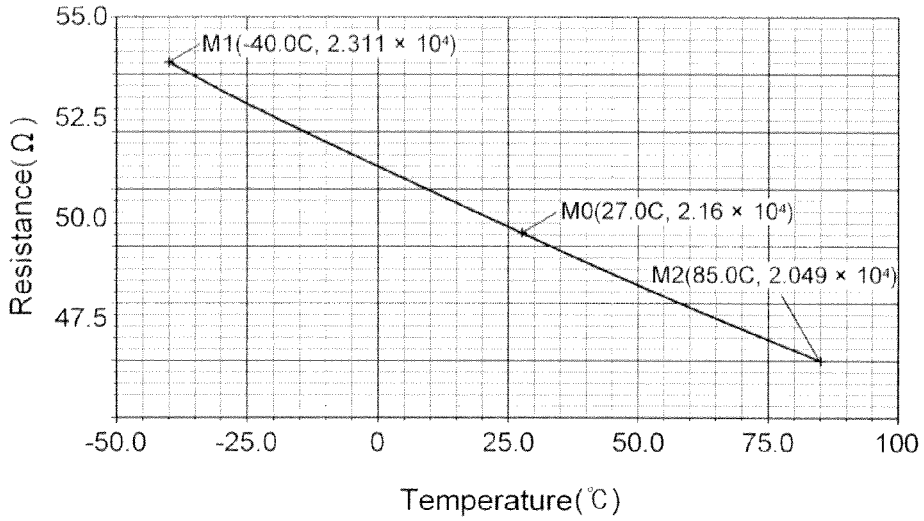
FIG. 5 is a view showing a simulation result of Resistor R4 of FIG. 3 depending on the temperature characteristics.

FIG. 5 is a view showing a simulation result of Resistor R4 of FIG. 3 depending on the temperature characteristics.

As shown in FIG. 5, it can be seen that Resistor R4 exhibits about 12% of resistance change due to the temperature change of −40 85. Therefore, it can be seen that it is necessary to have a constant resistance value against the temperature change in order to stabilize the output voltage (Vregout) of the first regulator, which is represented by Equation 2 below, $$Vregout=Iout_S R4 \quad \text{[Equation 2]}$$

As described above, the present invention is to provide a circuit, of outputting a temperature compensation power voltage from variable power, capable of compensating for a deterioration in output characteristics of the regulator due to the temperature change, by using the regulator designed in only one stage in a circuit having a large-width variable power voltage.

Figure 6:
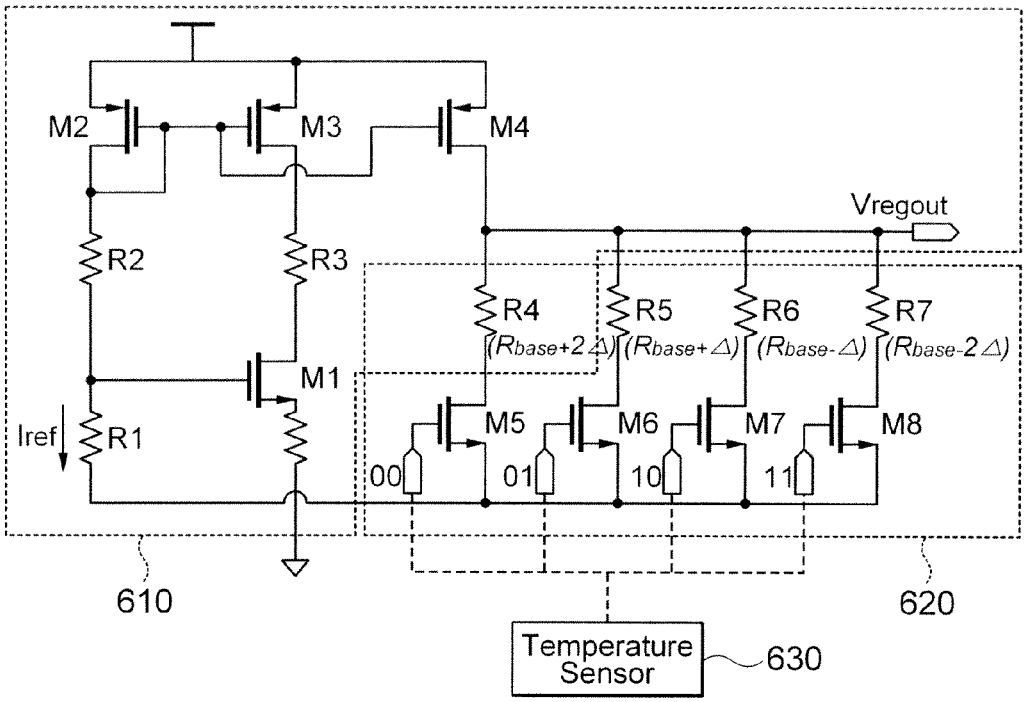
FIG. 6 is a view schematically showing a structure of a circuit of outputting a temperature compensation power voltage from variable power according to an exemplary embodiment of the present invention.

FIG. 6 is a view schematically showing a structure of a circuit of outputting a temperature compensation power voltage from variable power according to an exemplary embodiment of the present invention.

Referring to FIG. 6, the circuit of outputting a temperature compensation power voltage from variable power according to the present invention may include a regulator circuit unit 610, a resistance compensation circuit unit 620, and a temperature sensor 630.

The regulator circuit unit 610 is composed of a serial-parallel combination circuit of a plurality of transistors (for example, MOSFET) M1~M4 and a plurality of resistors R1 R4, and converts the variable power to a specific voltage (e.g., DC 5V) desired by the system and supplies it.

The resistance compensation circuit unit 620 is formed at an output terminal of the regulator circuit unit 610, and compensates for the change in resistance value according to the temperature change. Here, this resistance compensation circuit unit 620 may be composed of a circuit where a plurality of unit circuits consisting of resistors R4 R7 having different resistance values and transistors M5 M7, which are connected in series with each other, are connected in parallel with each other.

Here, the unit circuit may be 4 in number, and when a predetermined ratio of resistance change value based on base resistance value ($R_{base}$) is $^{\Delta}$, of four resistance values respectively constituting the unit circuits may be "$R_{base}+2^{\Delta}$", "$R_{base}+^{\Delta}$", "$R_{base}-^{\Delta}$", and "$R_{base}-2^{\Delta}$". Here, these unit circuits are not limited to being necessarily 4 in number, and in some cases, the number of unit circuits may be 4 or more. Also, the resistance values are not limited to four values as shown in the present exemplary embodiment, that is, "$R_{base}+2^{\Delta}$", "$R_{base}+^{\Delta}$", "$R_{base}-^{\Delta}$", and "$R_{base}-2^{\Delta}$", and in some cases, the resistance values may be increased or decreased.

In addition, the respective transistors M5 M7 in the unit circuits are electrically connected with the temperature sensor 630, and receive the output value from the temperature sensor 630 to be switched on/off, so that the current is conducted or blocked through the corresponding resistors R4 R7 in series connected with the transistors M5 M7, thereby compensating for the change in resistance value according to the temperature change.

In addition, a field effect transistor (FET) may be used for the respective transistors M5 M7 in the unit circuit.

Also, a metal oxide semiconductor field effect transistor (MOSFET) may be preferably used for the respective transistors M5 M7 in the unit circuits.

The temperature sensor 630 senses the change in surrounding temperature in the electronic circuit system employing the regulator circuit unit 610 to supply the corresponding output value to the resistance compensation circuit unit 620, so that the compensation circuit unit 620 compensates for the change in resistance value according to the temperature change.

Here, this temperature sensor 630 outputs corresponding signal values (digital values) different: from each other according to the predetermined temperature ranges.

For example, the temperature sensor 630 may be set to output a digital value "11" in the temperature range of −40 0; a digital value "10" in the temperature range of 0 40; a digital value "01" in the temperature range of 40~80; and a digital value "00" in the temperature range of 80 120

In addition, a bipolar junction transistor (BJT) may be used as the temperature sensor 630, in order to show different output values according to the detected temperatures.

Here, the present exemplary embodiment exemplifies that the output value (bit) from the temperature sensor 630 is 2 bit, but the present invention is not limited to necessarily outputting 2 bit. In some cases, the higher bit value (e.g., 3 bit, 4 bit, or the like) may be outputted. In the cases where the number of digital bits is increased at the time of outputting, the temperature range may be more precisely set and thereby adjustment of the resistance value may be possible.

Then, the operation of the circuit of outputting a temperature compensation power voltage from variable power of the present invention having the above structure and a method of outputting a temperature compensation power voltage from variable power using the same will be described.

Figure 7:
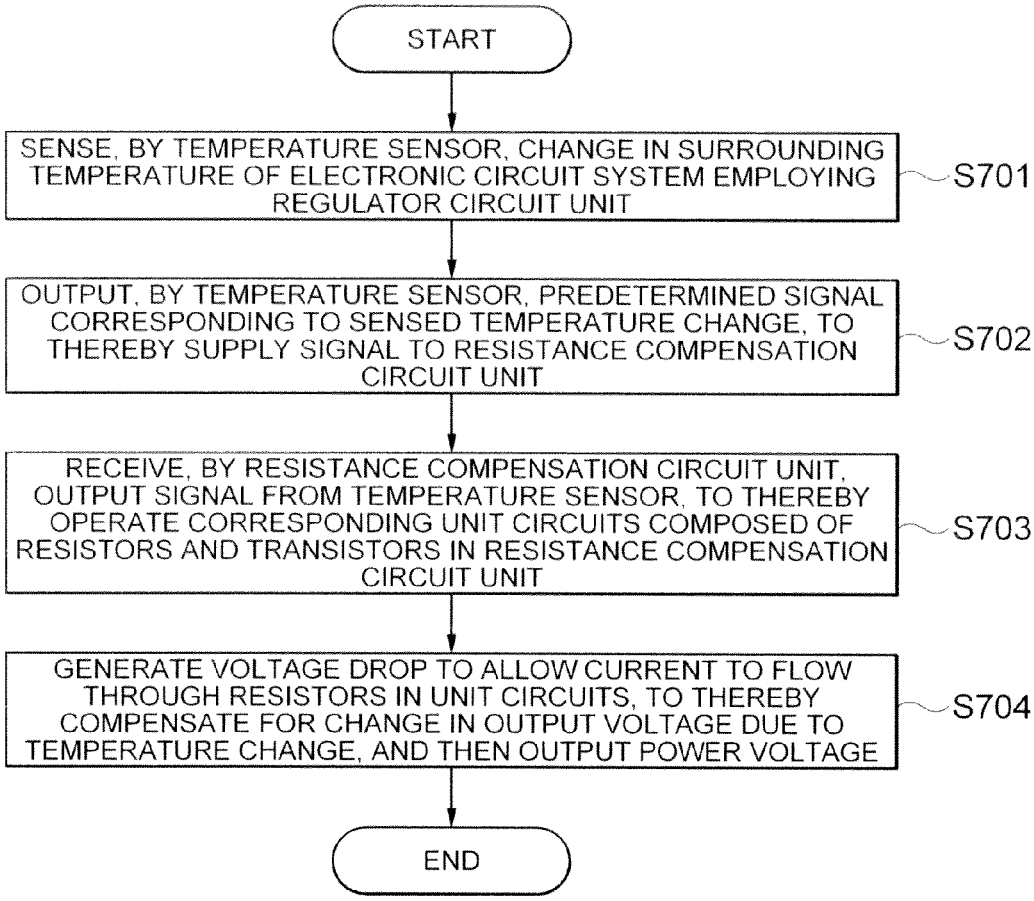
FIG. 7 is a flow chart showing an implementing procedure of a method of outputting a temperature compensation power voltage from variable power according to an exemplary embodiment of the present invention.

FIG. 7 is a flow chart showing an implementing procedure of a method of outputting a temperature compensation power voltage from variable power according to an exemplary embodiment of the present invention.

Referring to FIG. 7, the method of outputting a temperature compensation power voltage from variable power according to the present invention outputs the temperature compensation power voltage from the variable power by using the circuit outputting a temperature compensation power voltage from variable power including the regulator circuit unit 610, the resistance described above. First, the change of surrounding temperature in the electronic circuit system employing the regulator circuit unit 610 is sensed by the temperature sensor 630 (S701).

After that, a signal corresponding to the sensed temperature change, which is previously set by the temperature sensor 630, is outputted and supplied to the resistance compensation circuit unit 620 (S702).

Then, the output signal from the temperature sensor 630 is received by the resistance compensation circuit unit 620, to thereby operate corresponding unit circuits composed of the resistors R4 R7 and the transistors M5 M7 in the resistance compensation circuit unit 620 (S703).

Then, a current is controlled to flow through the resistors R4 R7 in the unit circuits, to thereby induce voltage drop, so that the change in output voltage according to the temperature change is compensated to thereby output a power voltage (S704).

In a series of procedures as such, in S702, the temperature sensor 630 outputs different signals (digital values) respectively corresponding to the predetermined temperature ranges (for example, −40 0, 0 40, 40 80, and 80 120).

Here, the temperature sensor 630 may be set to output a digital value "11" in the temperature range of −40 0; a digital value "10" in the temperature range of 0 40; a digital value "01" in the temperature range of 40~80; and a digital value "00" in the temperature range of 80 120.

In addition the resistance compensation circuit unit 620 may be composed of a circuit where a plurality of unit circuits consisting of resistors R4 R7 having different resistance values and transistors M5 M7, which are connected in series with each other, are connected in parallel with each other.

Here, the unit circuit may be 4 in number, and when a predetermined ration of resistance change value based on base resistance value ($R_{base}$) is $^{\Delta}$, all of four resistance values for the unit circuits may be "$R_{base}2^{\Delta}$", "$R_{base}+^{\Delta}$", "$R_{base}-^{\Delta}$", and "$R_{base}-2^{\Delta}$", respectively.

Here, the signal output and compensation for the change in resistance value by the temperature sensor 630 in S702 and S703 will be further explained.

Figure 8:
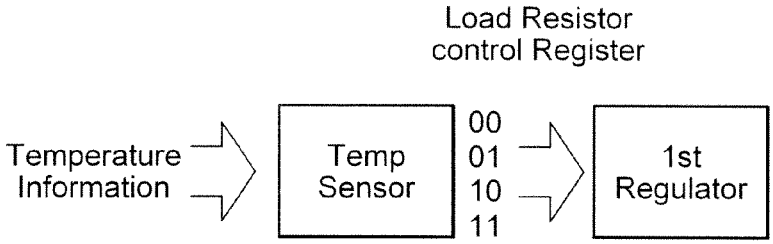
FIG. 8 is a view schematically showing an operation of a temperature sensor employed in the circuit of outputting a temperature compensation power voltage from variable power according to the present invention.
Figure 9:
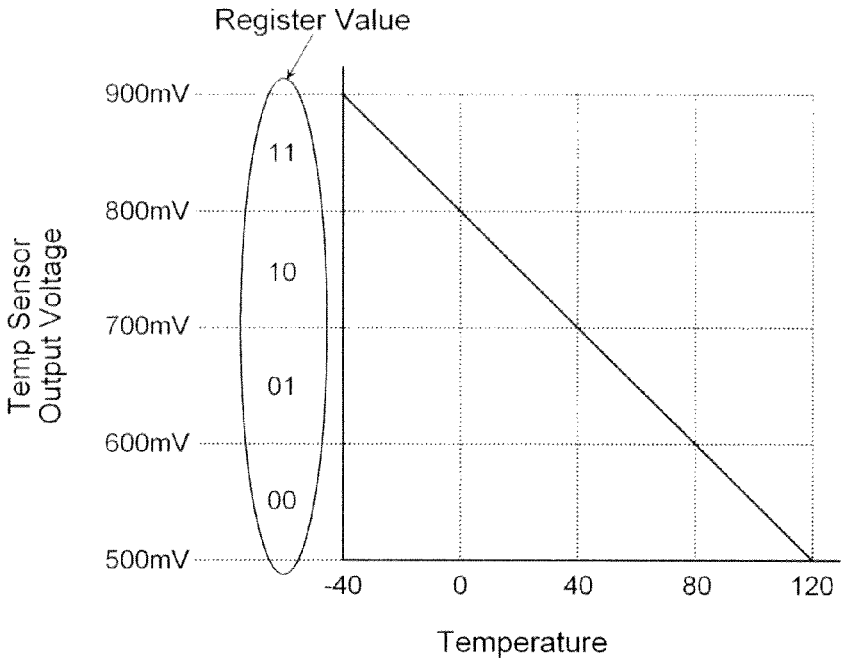
FIG. 9 is a view showing a characteristic curve of a temperature sensor employed in the circuit of outputting a temperature compensation power voltage from variable power according to the present: invention.

FIG. 8 is a view schematically showing an operation of the temperature sensor employed in the circuit of outputting a temperature compensation power voltage from variable power according to the present invention, and FIG. 9 is a view showing a characteristic curve of the temperature sensor.

Referring to FIGS. 8 and 9, as described above, the temperature sensor 630 senses the temperature change and outputs a signal (digital value) corresponding to the sensed temperature. Here, the temperature sensor 630 shows a voltage output linearly decreasing with respect to the temperature in the operating temperature range of a system, −40 120 (see, FIG. 9). In addition, the temperature sensor 630 may be set to output a digital value "11" in the temperature range of −40 0; a digital value "10" in the temperature range of 0 40; a digital value "01" in the temperature range of 40~80; and a digital value "00" in the temperature range of 80 120. For example, when the temperature sensor 630 outputs the digital value "11", this means that the temperature is in the range of −40 0. As shown in FIG. 5 as described above, the resistance has a high value at a low temperature, and thus, the resistance needs to be decreased when the temperature sensor 630 outputs "11" in order that the output voltage (Vregout) is constant. On the contrary, when the temperature sensor 630 outputs "00", this means that the temperature is in the range of 80 120. As shown in FIG. 5 described above, the higher temperature leads to the lower resistance value, and thus, in order to maximally decrease the temperature change of the output voltage (Vregout), the resistance value needs to be increased when the temperature sensor 630 outputs "00", to thereby provide a constant output voltage. The circuit configured considering such the manner is a circuit of outputting a temperature compensation power voltage from variable power of the present invention as shown in FIG. 6.

Figure 10:
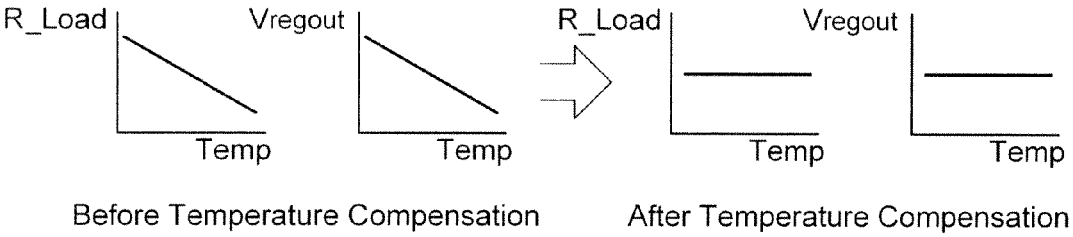
FIG. 10 is a view conceptually showing a temperature change improvement effect of an output voltage by the method of outputting a temperature compensation power voltage from variable power according to the present invention.

Meanwhile, FIG. 10 is a view conceptually showing a temperature change improvement effect of an output voltage by the method of outputting a temperature compensation power voltage from variable power according to the present invention.

As shown in FIG. 10, it can be confirmed that, with the respect to the temperature change, before temperature compensation, the load resistance value is decreased as the temperature rises, and thus, the output voltage (Vregout) is also deteriorated, but after temperature compensation, the resistance is constant due to the temperature compensation, and thus, the output voltage (Vregout) is also maintained a constant value with respect to the temperature change.

As described above, according to the circuit and method of outputting a temperature compensation power voltage from variable power according to the present invention, the voltage is constant by temperature (resistance) compensation according to the temperature change in the electronic circuit system, and thus, the regulator designed in only one stage is used in the circuit having a large-width variable power voltage, thereby compensating for the decrease in output characteristics of the regulator due to the temperature change. In addition, since the regulator designed in only one stage is used, the configuration of the system can be simplified.

As set forth above, according to the exemplary embodiments of the present invention, a voltage is constant by temperature (resistance) compensation according to the temperature change of the electronic circuit system, and thus, the deterioration in output characteristics of the regulator due to the temperature change can be compensated by using the regulator designed in only one stage in the circuit having a large-width variable power voltage. In addition, since the regulator designed in only one stage is used, the configuration of the system can be simplified.

Although the exemplary embodiments of the present invention have been disclosed for illustrative purposes, the present invention is not limited thereto, and it will be appreciated to those skilled in the art that various modifications, additions and substitutions are possible, without departing from the scope and spirit of the invention as disclosed in the accompanying claims. Therefore, the protection scope of the present invention must be construed by the following claims and it should be construed that all spirits within a scope equivalent thereto are included in the scope of the present invention.

What is claimed is:

1. A circuit of outputting a temperature compensation power cottage from variable power, the circuit comprising:

a regulator circuit unit composed of a serial-parallel combination circuit of a plurality of transistors and a plurality of resistors, and converting the variable power into a predetermined voltage desired by a system;

a resistance compensation circuit unit provided at an output terminal of the regulator circuit unit, and compensating for a change in resistance value due to the temperature change; and a temperature sensor sensing a change in surrounding temperature of an electronic circuit system employing the regulator circuit unit and supplying an output value corresponding to the sensed temperature change to the resistance compensation circuit unit, to thereby allow the resistance compensation circuit unit to compensate for the change in resistance value due to the temperature change.

2. The circuit according to claim 1, wherein the resistance compensation circuit unit is composed of a plurality of unit circuits connected in parallel with each other, the plurality of unit circuits consisting of resistors having different resistance values and transistors, which are connected in series with each other.

3. The circuit according to claim 2, wherein the unit circuit is 4 in number, and when a predetermined ratio of resistance change value based on a base resistance value ($R_{base}$) is, all of the four resistance values for the unit circuits are "$R_{base}+2$", "$R_{base}+$", "$R_{base}-$", and "$R_{base}-2$", respectively.

4. The circuit according to claim 2, wherein the transistors in the unit circuits are electrically connected with the temperature sensor, and compensate for the change in resistance value due to the temperature change by receiving the output value from the temperature sensor to thereby be switched on/off, so that a current is conducted or blocked through corresponding resistors connected in series with the transistors.

5. The circuit according to claim 2, wherein the transistor in each of the unit circuits is a field effect transistor (FET).

6. The circuit according to claim 5, wherein the transistor in each of the unit circuits is a metal oxide semiconductor field effect transistor (MOSFET).

7. The circuit according to claim 1, wherein the temperature sensor is composed of bipolar junction transistors to show a different output according to the sensed temperature.

8. The circuit according to claim 1, wherein the temperature sensor outputs different signal values (digital values) respectively corresponding to predetermined temperature ranges.

9. The circuit according to claim 8, wherein the temperature sensor is set to output a digital value "11" in the temperature range of −40 0; a digital value "10" in the temperature range of 0 40; a digital value "01" in the temperature range of 40~80; and a digital value "00" in the temperature range of 80 120.

10. A method of outputting a temperature compensation power voltage from variable power by using a circuit of outputting a temperature compensation power voltage from variable power including a regulator circuit unit, a resistance compensation circuit unit, and a temperature sensor, the method comprising:

a) sensing, by the temperature sensor, a change in surrounding temperature of an electronic circuit system employing the regulator circuit unit;

b) outputting, by the temperature sensor, a predetermined signal corresponding to the sensed temperature change, to thereby supply the signal to the resistance compensation circuit unit;

c) receiving, by the resistance compensation circuit unit, the output signal from the temperature sensor, to thereby operate corresponding unit circuits composed of resistors and transistors in the resistance compensation circuit unit; and d) generating a voltage drop to allow a current to flow through the resistors in the unit circuits, to thereby compensate for the change in output voltage due to the temperature change, and then outputting a power voltage.

11. The method according to claim 10, wherein in Stage b), the temperature sensor outputs different signal values (digital values) corresponding to predetermined temperature ranges.

12. The method according to claim 11, wherein the temperature sensor is set to output a digital value "11" in the temperature range of −40 0; a digital value "10" in the temperature range of 0 40; a digital value "01" in the temperature range of 40~80; and a digital value "00" in the temperature range of 80 120.

13. The method according to claim 10, wherein in Stage b), the resistance compensation circuit unit is composed of a plurality of unit circuits connected in parallel with each other, the plurality of unit circuits consisting of resistors having different resistance values and transistors, which are connected in series with each other.

14. The method according to claim 13, wherein the unit circuit is 4 in number, and when a predetermined ratio of resistance change value based on a base resistance value ($R_{base}$) is, all of four resistance values for the unit circuits are "$R_{base}$+2", "$R_{base}$+", "$R_{base}$−" and "$R_{base}$−2", respectively.

* * * * *